US008621790B2

(12) United States Patent
Lekhtman

(10) Patent No.: US 8,621,790 B2
(45) Date of Patent: Jan. 7, 2014

(54) LOW COST HURRICANE AND EARTHQUAKE RESISTANT HOUSE

(76) Inventor: Gregory Lekhtman, Montreal (CA)

( * ) Notice: Subject to any disclaimer, the term of this patent is extended or adjusted under 35 U.S.C. 154(b) by 12 days.

(21) Appl. No.: 13/493,500

(22) Filed: Jun. 11, 2012

(65) Prior Publication Data

US 2013/0042538 A1 Feb. 21, 2013

Related U.S. Application Data

(60) Provisional application No. 61/573,051, filed on Aug. 19, 2011.

(51) Int. Cl.
*E04B 1/98* (2006.01)

(52) U.S. Cl.
USPC ..... 52/167.1; 52/79.1; 52/79.4; 52/80.1

(58) Field of Classification Search
USPC ..... 52/79.1, 79.4, 79.9, 167.1, 245, 247, 52/293.2, 293.3, 382, 396.05, 405.3, 80.1, 52/80.2, 81.1
See application file for complete search history.

(56) References Cited

U.S. PATENT DOCUMENTS 1,050,130 A * 1/1913 Harvey ..... 52/583.1
2,074,592 A * 3/1937 Rowell ..... 52/223.3
2,343,764 A * 3/1944 Buckminster ..... 52/246
2,649,625 A * 8/1953 Johnson ..... 52/246
2,792,794 A * 5/1957 Miller ..... 52/66
2,929,236 A * 3/1960 Steward et al. ..... 52/223.3
2,967,494 A * 1/1961 Rosenfeld ..... 109/1 S
3,145,502 A * 8/1964 Rubenstein ..... 52/223.7
3,153,302 A * 10/1964 Wheeler ..... 52/73
3,824,751 A * 7/1974 Shelander ..... 52/223.3
4,015,381 A * 4/1977 Schmidt ..... 52/199
4,112,644 A * 9/1978 Allen ..... 52/245
4,171,999 A * 10/1979 Allen ..... 156/69
4,226,061 A 10/1980 Day
4,228,788 A * 10/1980 Moeser ..... 123/437
4,267,676 A * 5/1981 Marchaj ..... 52/167.1
4,479,334 A * 10/1984 Goode ..... 52/197
4,686,804 A * 8/1987 Smith ..... 52/169.6
4,709,723 A * 12/1987 Sidaway et al. ..... 137/584
4,726,567 A * 2/1988 Greenberg ..... 256/19
4,788,803 A * 12/1988 Seitz ..... 52/82
4,955,166 A * 9/1990 Qualline et al. ..... 52/169.6
5,117,593 A * 6/1992 Tiernan ..... 52/20
5,134,830 A * 8/1992 Dykmans ..... 52/745.01
5,794,389 A * 8/1998 Vysma ..... 52/169.6
5,930,961 A * 8/1999 Beaudet ..... 52/169.6
6,076,313 A * 6/2000 Pannell et al. ..... 52/169.6
6,385,919 B1 * 5/2002 McCarthy ..... 52/169.6

(Continued)

FOREIGN PATENT DOCUMENTS

GB 488013 A 6/1938
GB 539978 A 10/1941

*Primary Examiner* — James Buckle, Jr.
(74) *Attorney, Agent, or Firm* — Equinox Protection; Franz Bonsang

(57) ABSTRACT

A low-cost hurricane and earthquake resistant house structure includes a rounded shape external wall constructed of a plurality of circumferentially adjacent wall segments, each secured to an adjacent structural vertical stud secured to the ground via a shock absorber. Each wall segment includes a plurality of blocks located and secured on top of one another. A foundation groove receives at least a portion of a lowest block of each wall segment therein, and spaced from inside foundation walls. An aerodynamic roof is secured to the vertical studs, and a floor is mounted on shock absorbers on the ground and connected to the wall with a flexible material.

20 Claims, 7 Drawing Sheets

(56) References Cited

U.S. PATENT DOCUMENTS 6,481,166 B2 * 11/2002 Shelton ..... 52/167.1
6,722,091 B1 * 4/2004 Leslie et al. ..... 52/246
6,735,913 B2 * 5/2004 Sanders et al. ..... 52/284
7,946,086 B2 * 5/2011 Hammer et al. ..... 52/223.5
8,191,318 B2 * 6/2012 Kitagawa ..... 52/82
2009/0025306 A1 1/2009 Reed

* cited by examiner

LOW COST HURRICANE AND EARTHQUAKE RESISTANT HOUSE

CROSS-REFERENCE TO RELATED APPLICATIONS

This application claims priority of U.S. Provisional Application for Patent No. 61/573,051 filed Aug. 19, 2011, the content of which is incorporated by reference herein in its entirety.

FIELD OF THE INVENTION

The present invention relates to buildings and is more particularly concerned with a house or building with a low-cost hurricane and earthquake resistant structure.

BACKGROUND OF THE INVENTION

It is well known in the art of buildings to have the structure, or part thereof, made to be hurricane and/or earthquake resistant. However, these structures are generally so costly than only commercial or office buildings can afford to incorporate them, or even luxury villas or the like. None of these house structures are capable of being built locally directly in devastated areas where access to inexperienced labor and minimum use of expensive machining is a reality.

When nature disasters, such as hurricanes, earthquakes and the like, happen, it is not rare to see that a significant amount of typical houses or homes are at least partially, if not totally, destroyed since the owner of these houses cannot afford to include special structures to make them resistant to the nature disasters.

Accordingly, there is a need for an improved low-cost hurricane and earthquake resistant house.

SUMMARY OF THE INVENTION

It is therefore a general object of the present invention to provide an improved low-cost hurricane and earthquake resistant house.

An advantage of the house of the present invention is that it has an aerodynamic shape that makes the air resistance, drag and lift forces will be drastically lower compared to the other more conventional shapes of the house construction.

Another advantage of the house of the present invention is that it has a structure with lateral and frontal stability to strong winds because the circular wall is freely inserted in the ground with the support of the groove and rigid poles.

A further advantage of the house of the present invention is that it has a vertical stability of the structure during hurricane because of the weight of the structure and aerodynamic shape of the roof and the in ground shock absorbers of the poles.

Yet another advantage of the house of the present invention is that it has a good resistance to an earthquake because of the fact that the outside wall is inserted in the ground with the help of a concrete groove and shock absorbing poles rather than being anchored. This earthquake resistance is enhanced because the floor and the wall are structurally independent from one another and will produce independent movement on the respective shock absorbers.

Another advantage of the house of the present invention is that it has technologies that enable a fast reliable construction, typically directly in devastated areas, at low cost of materials, minimum use of machining tools and unskilled labor. The materials typically used for the fabrication of wall blocks are preferably locally found in nature for low cost and improved strength and resistance.

Yet a further advantage of the house of the present invention is that it has an aerodynamic roof shape that minimizes the effect of winds, especially high velocity winds, on the structure of the house. Such an aerodynamic roof, when being concave, further allows the collection of rain water for recycling as well as an opening for air intake and exhaust from the house.

According to an aspect of the present invention there is provided a low-cost hurricane and earthquake resistant house, said house comprising:

a typically rounded shape wall including a plurality of circumferentially adjacent wall segments secured to structural vertical polls secured to the ground via shock absorbing mechanism; each said wall segment including a plurality of blocks located and secured on top of one another;

the wall being partially located inside a foundation groove.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings, in most of which many parts have voluntarily been omitted for clarity purposes, the preferred embodiments of the present invention will be herein described for indicative purpose and by no means as of limitation.

Referring to FIGS. 1 through 5, there is schematically shown an embodiment 10 of a low-cost hurricane and earthquake resistant house in accordance with the present invention.

Figure 2:
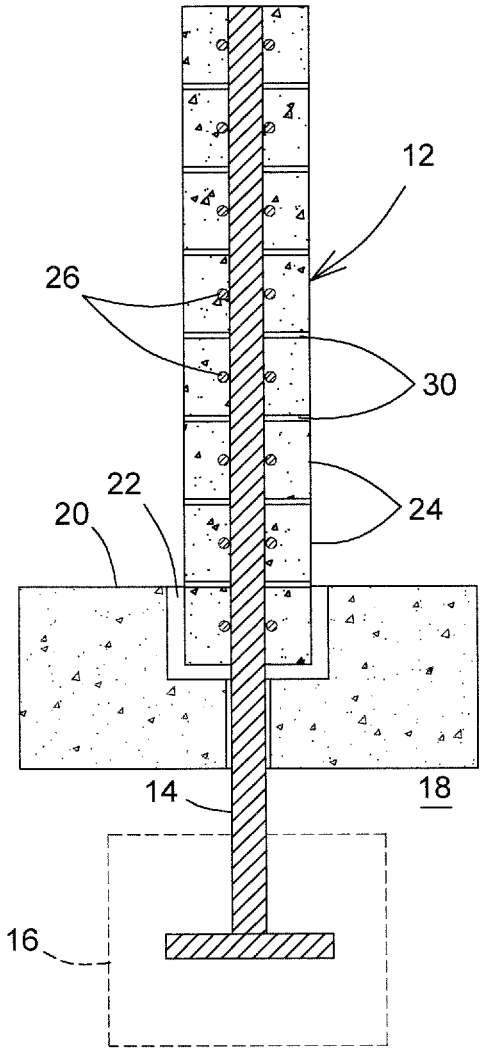
FIG. 2 is a cross-section view of a segment of the outside wall of the house of FIG. 1.

The structure of the house 10 includes a round shaped aerodynamic, typically circular (or elliptical) wall 12 (when seen from the top) formed of a plurality of vertical wall segments 13 located adjacent one another. Elongated rigid vertical structural studs 14 (poles or posts) or the like, encapsulated in the wall 12 and supported at their base with respective shock absorbers 16 (of any type usually known in the art) at least partially inserted in the ground 18 act as a support for the wall 12 of the house 10, as shown in FIG. 2. Typically, there is a support stud 14 between adjacent wall segments 13.

A foundation structure 20 in a form of circular (or elliptical) pattern 22, typically grooved, acts as a support for the wall 12 of the house 10. A gap between the internal and external surfaces of the wall 12 and the corresponding facing internal surface of the groove 22, or pattern, is required to prevent any direct external environmental stress onto the wall structure 12, especially during earthquakes and the like natural disasters, and allow the free support of the wall structure 12. Obviously, this gap could be filled with any soft insulating and/or isolating material or the like which would not transmit any load from the foundation structure 20 to the wall 12.

Similarly, the studs 14, to reach the corresponding shock absorbers 16, typically freely extend through the foundation structure 20 without directly contacting the structure 20 to allow for relative movement there between in case of earthquakes or the like natural disaster and thermal expansion and contraction differentials. Obviously, the space between the studs 14 and the foundation structure 20 could be filled with a relatively flexible material insert 22' or the like that essentially closes the space while keeping the two structurally disconnected from one another.

Figure 1:
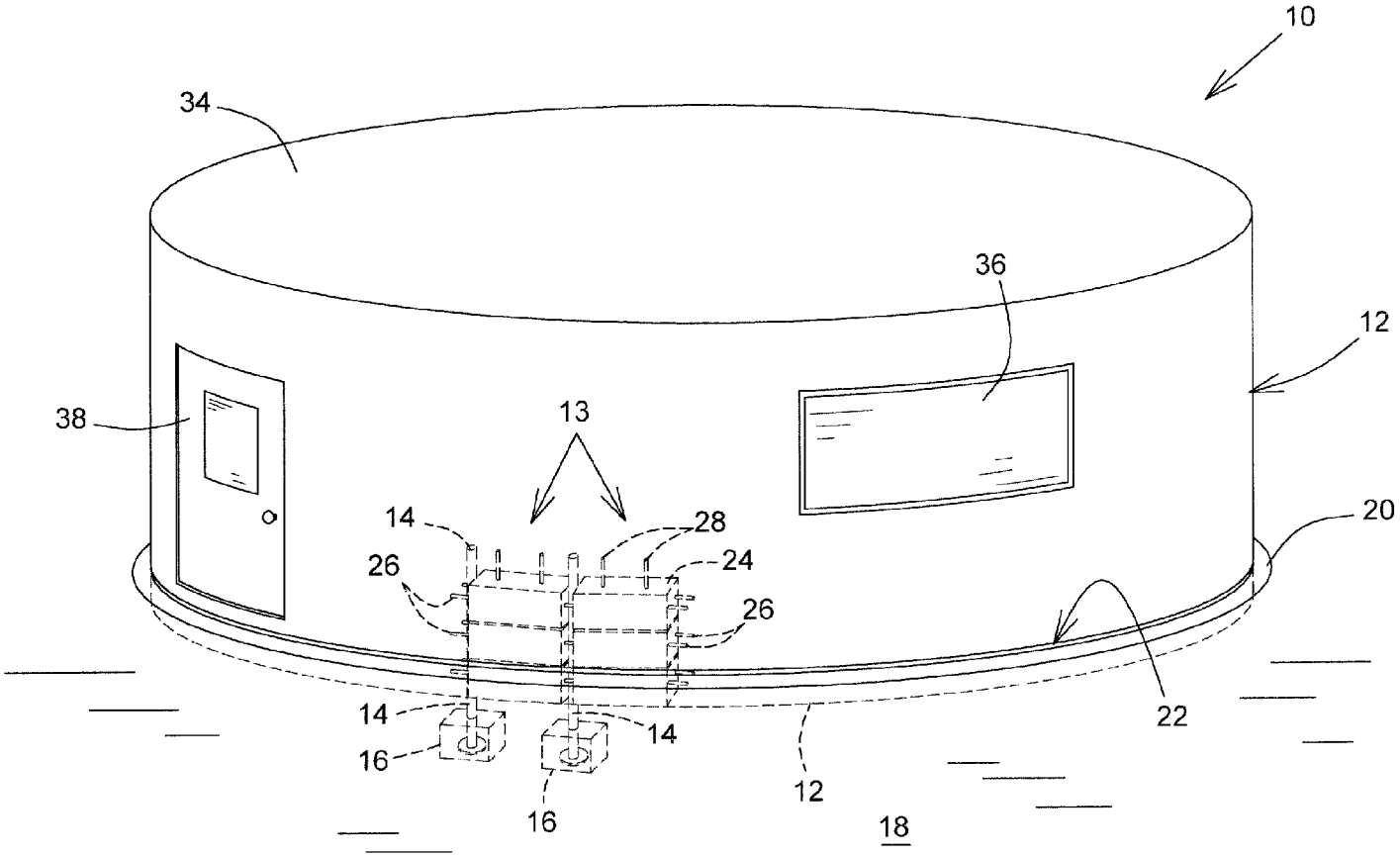
FIG. 1 is a schematic top perspective view of a low-cost hurricane and earthquake resistant house in accordance with an embodiment of the present invention.
Figure 3B:
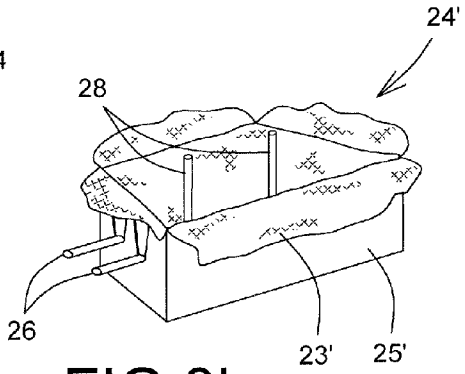
FIG. 3*b* is a view similar to FIG. 3*a* of another embodiment of a block of the wall segment of a house in accordance with the present invention.
Figure 3A:
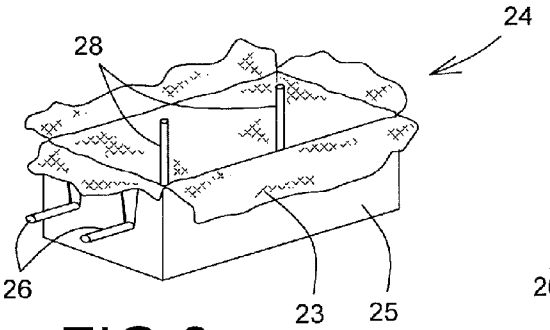
FIG. 3*a* is a schematic top perspective view of a block of the wall segment of the house.
Figure 4:
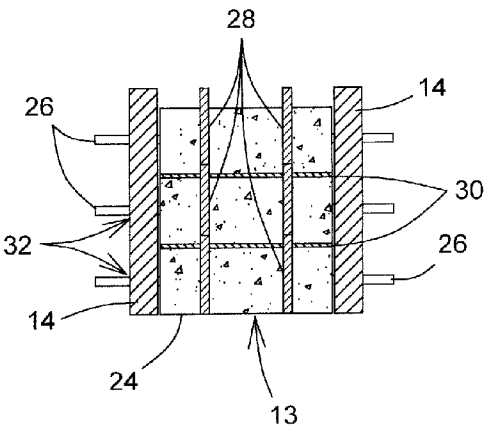
FIG. 4 is a front elevation sectional view taken along line 4-4 of FIG. 3.
Figure 3:
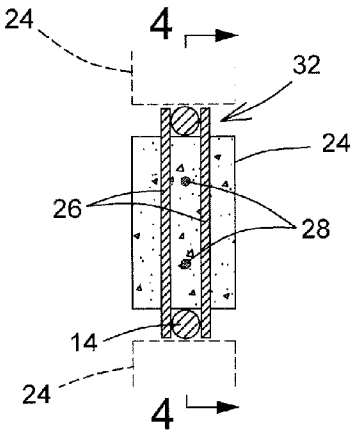
FIG. 3 is a plan section view of a wall segment of the house of FIG. 1.

Fiber-formed (or the like) flexible container 23, or outer-shell, with poured concrete-type settable filler and horizontal 26 and vertical 28 elongated members or rods (at least one of each, preferably two of each one) extending at least partially there through acts as a construction block 24, of a typically quadrilateral prism shape, preferably a rectangular right prism shape (as a conventional brick) which is held together (with another upper and/or lower block 24) by cement 30 and reinforced by clamping joints 32 between elongated members 26 and the adjacent studs 14, as shown in FIGS. 1, 3 and 4. The blocks 24, one example being shown in FIG. 3*a*, are preferably made on-site to form successive rows, starting with the lowest row, as bricks in a brick wall. When the radius of the wall structure 12 is relatively small, the blocks 24' may have a generally trapezoidal right prism shape (as a segment of an annulus), as shown in FIG. 3*b*, to ensure a substantially constant outside-to-inside spacing between adjacent lateral blocks 24'. To ensure the proper shape of the block 24, 24', the flexible container 23, 23' can be formed inside a rigid container 25, 25' acting as a forming structure during setting of the concrete inside the flexible outer-shell 23, 23', before being extracted therefrom. Each wall segment 13 is formed of a plurality of blocks 24 located and secured on top of one another. To this end, the upper portion of the vertical elongated members 28 of a lower block 24 typically slightly fit into a lower portion of the corresponding vertical member 28 of the superjacent block 24 which do not protrude downwardly there from.

In order to have a stronger structure, each block 24 may contain reinforcing material, of the same material than the outer-shell 23 or any other similar material, as a block composite fiber.

Although not specifically shown, the clamping joints 32 and spaces between construction blocks 24 are typically filled with concrete settable material or the like to enhance the strength, durability and aesthetic of the wall 10.

An aerodynamic roof 34 is built on specific supports (not shown) inserted on the upper ends of the studs 14.

Vegetation like grass 35 or the like or photovoltaic cells 37 can be placed on the surface of the roof 34 (see FIG. 6) to absorb the energy of the sun and produce vegetation or electricity for the house 10.

Windows 36, preferably curved or multi-planar or segmented (although not necessarily required), are placed to locally conform to the outside shaped surface 38 of the wall 12 in order to provide water proof contact and aerodynamic quality of the overall external wall 12. The also preferably curved, and preferably sliding (could also be hinged), doors 38 are also placed to locally conform to the outside surface 38 of the wall 12 in order to provide water proof contact and aerodynamic quality to outside wall 12 of the house 10. Although not shown, similar windows and doors could be used on the inside of the wall 12 of the house 10 for enhanced security.

Figure 5:
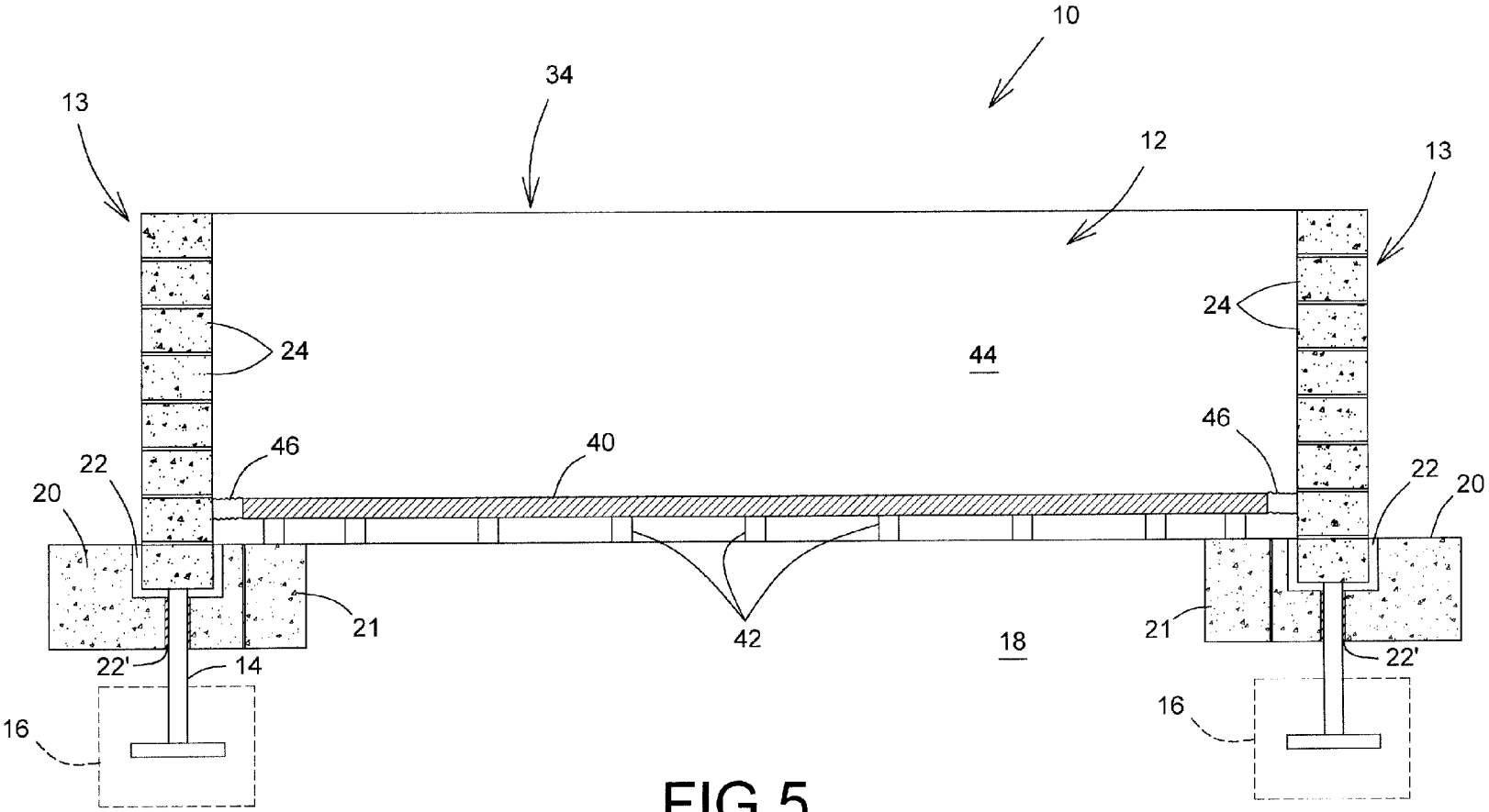
FIG. 5 is a diametrical section view of the house of FIG. 1.

The floor 40 is typically supported above the ground 18 with shock absorbing mechanisms 42 or the like, as shown in FIG. 5, such that the floor 40 is not directly anchored to the ground 18 or to the wall 12. For an increased stability, the outer periphery of the floor 40 is typically connected to an outer floor support foundation 21 located adjacent and inside of the foundation structure 20 supporting the wall structure 12, and spaced therefrom.

The gap between the edges of the floor 40 and inside surface 44 of the wall 12 is typically filled with flexible water proof material structure 46, such as membranes or the like, to prevent water and humidity from flowing there through, and prevent any to access there through to insects, small animals and the like.

Inside separate walls (not shown) are typically suspended from the ceiling 34 or erected from the floor 40 to divide inside space of the house 10 into separate rooms. Similarly, sanitary and kitchen equipment (not shown) can be chosen and installed from a variety of equipment available or could be custom build.

Ventilation (not shown) could be provided by wall vents, roof vents or ground vents (not shown). The design and construction of these vents shall not decrease the aerodynamic quality of the house 10.

The shock absorbers 16, and the shock absorbing mechanism 42, are made of a filer material that relatively rigid, not destructible over time and/or weather conditions (no fatigue and/or deformation over time, over the life expectancy of the house 10).

Figure 6:
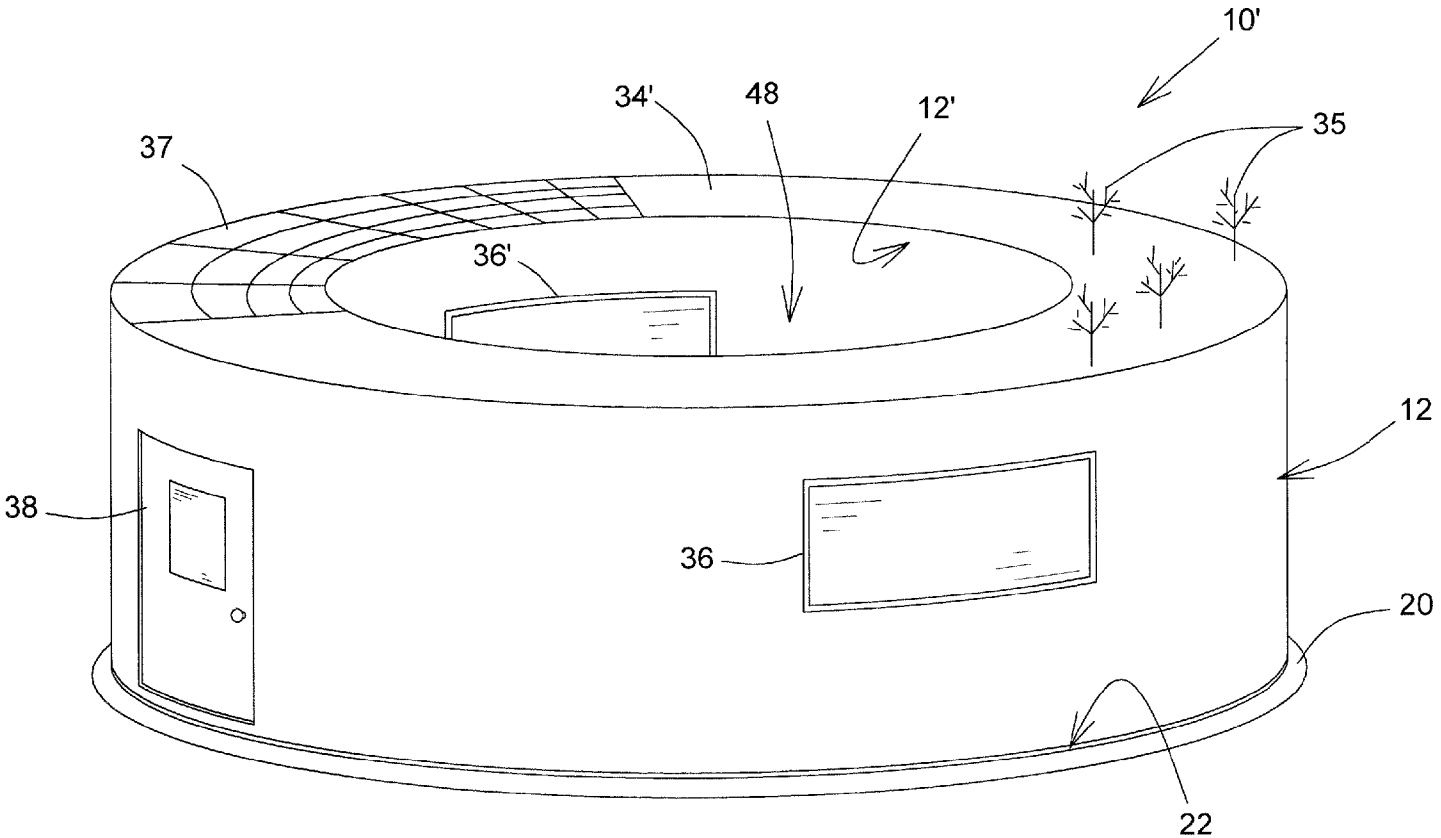
FIG. 6 is a schematic top perspective view of another embodiment of a low-cost hurricane and earthquake resistant house in accordance with the present invention.

The above technology elements could be used for a small aerodynamic circular one wall house (FIG. 1) or large aerodynamic circular multi walls house in accordance with the present invention. In FIG. 6, there is shown one (embodiment 10') of many examples of a large house with two circular walls, one inside wall 12' and one outside wall 12 thus creating doughnut (circular or elliptical annular) shaped roof 34' and house 10' with a large inside open yard 48. In such a house 10', same conforming curved windows 36' and doors (not shown) could be used on the inside wall 12' of the house 10' for enhanced security.

Figure 7:
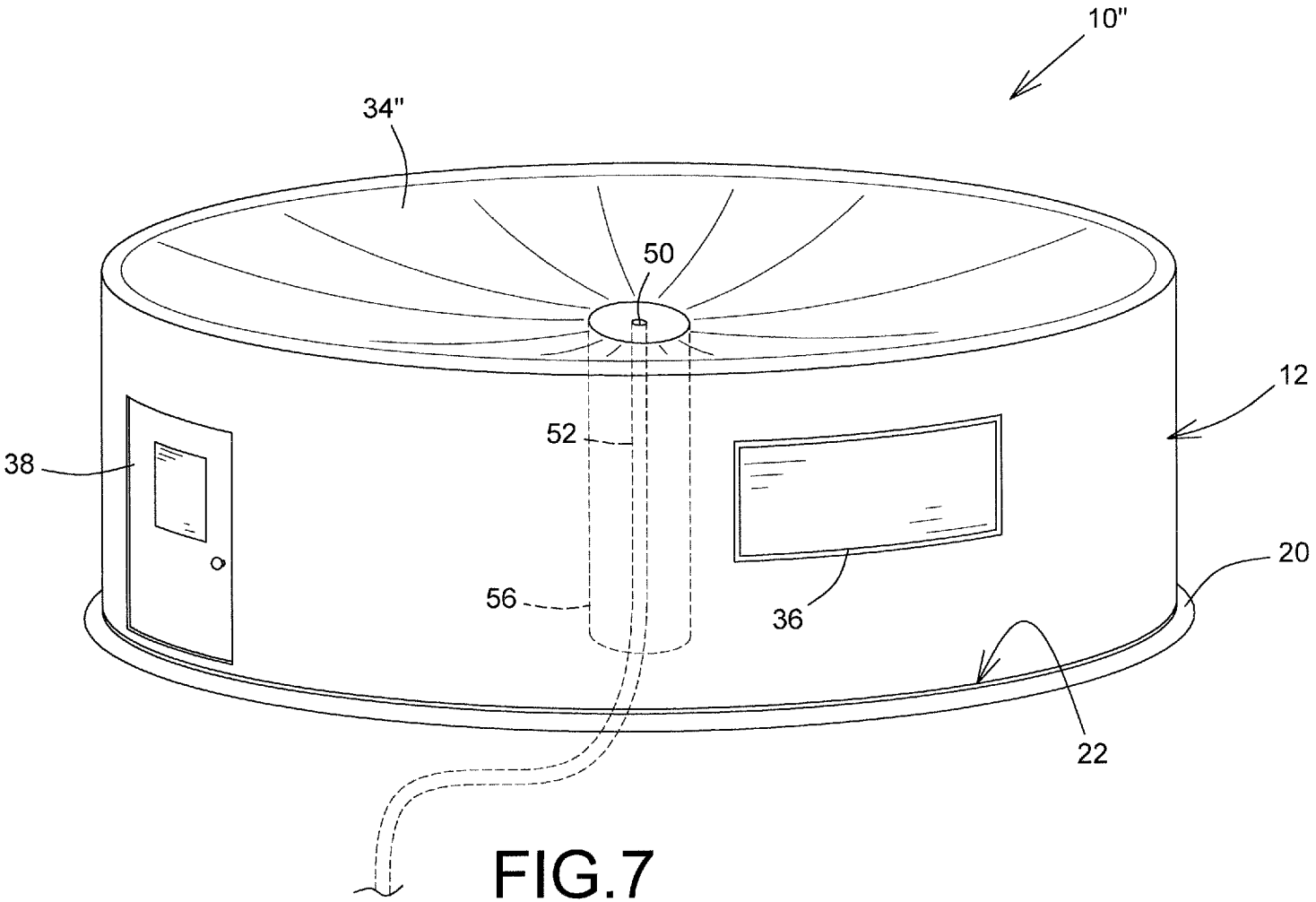
FIG. 7 is a schematic top perspective view of another embodiment of a low-cost hurricane and earthquake resistant house in accordance with the present invention.
Figure 8:
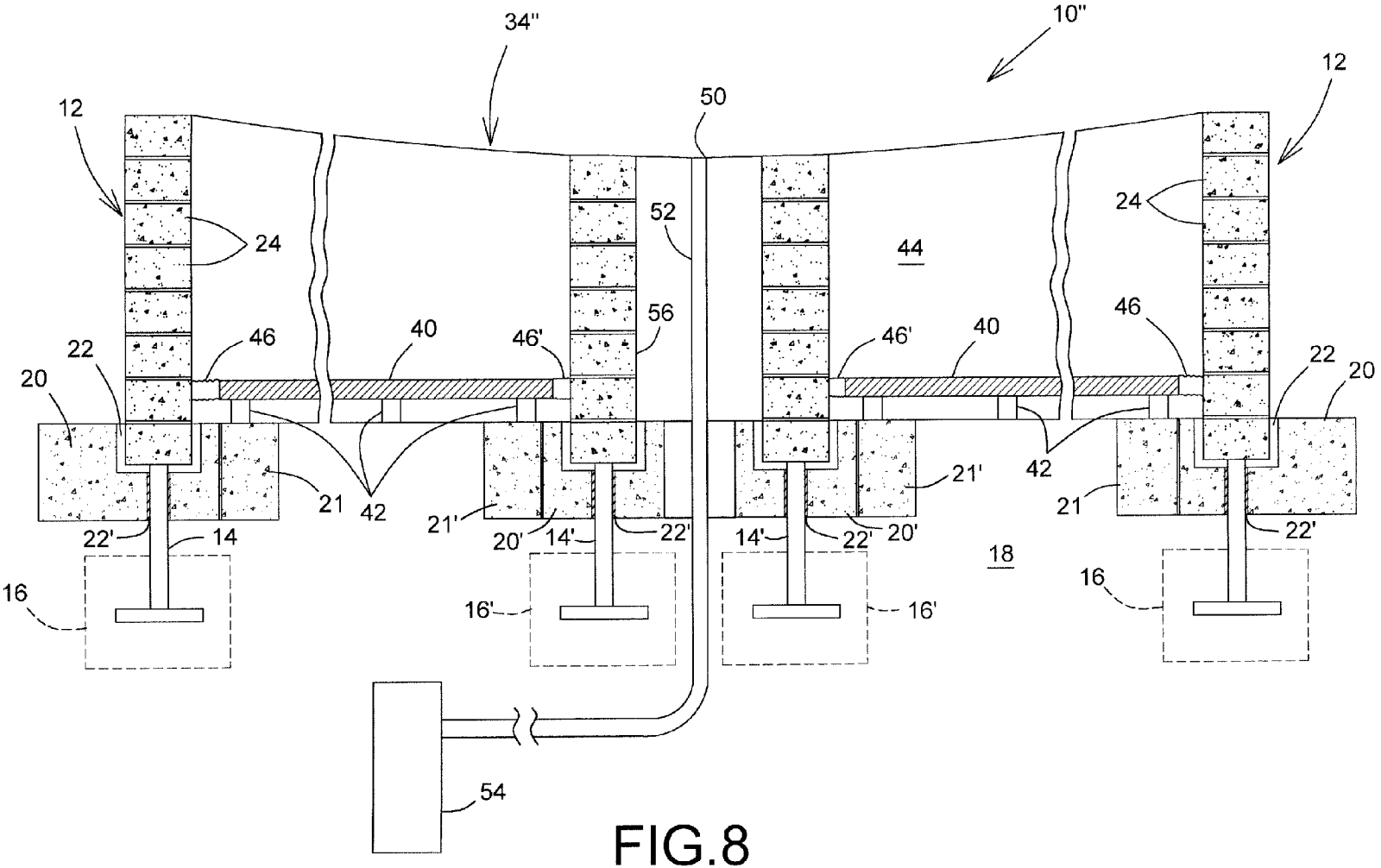
FIG. 8 is a view similar to FIG. 2 of a segment of the outside wall of the house of FIG. 7.

Another example of an embodiment 10" of an elliptical house of the present invention with an aerodynamic roof 34" is shown in FIGS. 7 and 8. The concave roof 34" is typically terminated at its bottom, or lowest (closest to the floor) region, typically the central region thereof, with a central drain 50 that, in addition to enable collecting of water in a water reservoir 54 and the like, preferably located outside (as indicated by the broken pipe) of the house perimeter below the ground level with proper water pumping mechanism and water outlet (not shown), via a drain pipe 52. The drain 50 is typically supported by an internal wall structure 56 (or drain pipe structure) that also provides an additional support for the roof 34", as well as a proper location for any additional convenience (not shown) piping (venting and plumbing) as air intake, air exhaust and air conditioning there through, and electrical wiring and the like. The internal wall structure 56 typically includes the same components connected thereto as the external wall structure 12, namely an inner foundation structure 20' with corresponding structural vertical studs 14' and shock absorbers 16', an inner floor support foundation 21', flexible material insert 22', and flexible water proof material structure 46' at the inner periphery of the floor 40.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A hurricane and earthquake resistant house structure, said house structure comprising:

a substantially rounded shape external wall including a plurality of circumferentially adjacent wall segments, each said wall segment being secured to an adjacent structural vertical stud secured to the ground via a shock absorbing mechanism; each said wall segment including a plurality of blocks located and secured on top of one another, each of said plurality of blocks being secured to said adjacent structural vertical stud; and a foundation pattern freely supporting at least a portion of a lowest block of each said wall segment, both said lowest block of each said wall segment and said adjacent structural vertical stud being spaced from said foundation pattern.

2. A house structure according to claim 1, wherein said foundation pattern is a foundation groove, wherein a gap is formed between an internal and external surface of said wall lowest block of each said wall segment and a corresponding surface of the groove.

3. A house structure according to claim 1, wherein each said block includes a generally flexible fiber-formed outer shell filled with settable filler.

4. A house structure according to claim 3, wherein each said block includes at least one substantially horizontal elongated member extending at least partially through the outer shell and the settable filler and securing to adjacent one of said vertical stud.

5. A house structure according to claim 4, wherein each said block includes at least one substantially vertical elongated member extending at least partially through the outer shell and the settable filler and securing to an adjacent one of said vertical stud of an adjacent upper said block.

6. A house structure according to claim 5, wherein each said block is secured to adjacent said blocks and adjacent said structural studs with settable material.

7. A house structure according to claim 1, wherein each said block has a substantially quadrilateral prism shape.

8. A house structure according to claim 7, wherein said quadrilateral prism shape is a rectangular right prism shape or a trapezoidal right prism shape.

9. A house structure according to claim 1, wherein a floor is supported on the ground with a floor shock absorbing mechanism, the floor is connected to the external wall with a flexible material structure.

10. A house structure according to claim 1, wherein an aerodynamic roof is supported by an upper end of the vertical studs.

11. A house structure according to claim 10, wherein the aerodynamic roof is substantially concave and includes a drain opening at a lowest region thereof closest to a floor of the house structure.

12. A house structure according to claim 11, wherein the drain opening is supported by an inner wall structure supporting the lowest region of the roof.

13. A house structure according to claim 11, wherein the lowest region is a central region of the roof.

14. A house structure according to claim 11, wherein the drain opening connects to a water collecting reservoir.

15. A house structure according to claim 1, wherein the external wall includes at least one access door.

16. A house structure according to claim 15, wherein the external wall includes at least one window.

17. A house structure according to claim 16, wherein at least one of the at least one access door and the at least one window is curved to locally conform to a shape of the external wall.

18. A house structure according to claim 1, wherein a gap between each said wall segment and the foundation pattern is filled with a soft material.

19. A house structure according to claim 1, wherein a space between each said structural vertical stud and the foundation pattern is filled with a flexible material insert.

20. A house structure according to claim 1, wherein the external wall has a circular shape or an elliptical shape.

* * * * *